US011371278B2

(12) United States Patent
Huang et al.

(10) Patent No.: US 11,371,278 B2
(45) Date of Patent: Jun. 28, 2022

(54) WINDOW FOR AN ABOVE-GROUND POOL

(71) Applicant: BESTWAY INFLATABLES & MATERIAL CORP., Shanghai (CN)

(72) Inventors: Shuiyong Huang, Shanghai (CN); Chun Yang, Shanghai (CN); Changde Wan, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 233 days.

(21) Appl. No.: 16/610,691

(22) PCT Filed: May 4, 2017

(86) PCT No.: PCT/CN2017/082993
§ 371 (c)(1),
(2) Date: Nov. 4, 2019

(87) PCT Pub. No.: WO2018/201372
PCT Pub. Date: Nov. 8, 2018

(65) Prior Publication Data

US 2021/0156193 A1 May 27, 2021

(51) Int. Cl.

| | |
|---|---|
| ***E06B 3/58*** | (2006.01) |
| ***E06B 1/00*** | (2006.01) |
| ***E04H 4/14*** | (2006.01) |

(52) U.S. Cl.
CPC ..... *E06B 3/5842* (2013.01); *E04H 4/14* (2013.01); *E06B 1/006* (2013.01)

(58) Field of Classification Search
CPC ..... E06B 3/5842; E06B 1/006; B64C 1/1484; B64C 1/1492; B63B 2019/0015;
(Continued)

(56) References Cited

U.S. PATENT DOCUMENTS 2,572,947 A * 10/1951 Pevney ..... E06B 3/5427 52/208
3,905,617 A * 9/1975 Smith ..... A63B 19/02 280/206

(Continued)

FOREIGN PATENT DOCUMENTS

CN 204040544 U 12/2014
DE 908668 C * 4/1954 ..... E06B 3/5842

(Continued)

OTHER PUBLICATIONS

Extended European Search Report dated Dec. 18, 2020 (Dec. 18, 2020) issued on related European Patent Application 17908357.1 by the European Patent Office.

*Primary Examiner* — Michael Safavi
(74) *Attorney, Agent, or Firm* — Dickinson Wright PLLC

(57) ABSTRACT

A window for an above-ground pool is provided. The window includes a window portion (200) and a retainer bracket (250). The window portion (200) includes a window pane (210) and a peripheral rim (220) around a perimeter of the window pane (210). The peripheral rim (220) defines grooves (230) between inner and outer flanges (245, 235) on opposite side of the peripheral rim (220). The retainer bracket (250) includes a peripheral rim junction (260), a peripheral plate (270) and a joint (265) connecting the peripheral rim junction (260) and the peripheral plate (270).

15 Claims, 4 Drawing Sheets

(58) Field of Classification Search
CPC ... B63B 2019/0046; G21C 17/08; E04H 4/14; B60J 10/70
USPC ..... 52/204.67, 204.7
See application file for complete search history.

(56) References Cited

U.S. PATENT DOCUMENTS

| | | | | |
|---|---|---|---|---|
| 4,189,520 | A * | 2/1980 | Gauchel | B32B 27/00 428/520 |
| 4,669,410 | A | 6/1987 | Howell | |
| 6,532,877 | B1 * | 3/2003 | Hepburn | B61D 17/12 105/355 |
| 8,863,440 | B1 * | 10/2014 | Champlin | F41H 5/013 52/1 |
| 9,169,686 | B1 * | 10/2015 | Podyma | E06B 1/36 |
| 2006/0064811 | A1 | 3/2006 | Midkiff | |
| 2017/0130516 | A1 * | 5/2017 | Hill | E02F 9/16 |
| 2017/0150867 | A1 * | 6/2017 | Flores | A47L 15/4263 |
| 2018/0009300 | A1 * | 1/2018 | Forbes | B63B 19/00 |
| 2019/0300241 | A1 * | 10/2019 | Lin | B65D 41/16 |

FOREIGN PATENT DOCUMENTS

| | | | | |
|---|---|---|---|---|
| EP | 3501974 | A1 * | 6/2019 | B64C 1/32 |
| FR | 524350 | A * | 9/1921 | E06B 1/006 |
| JP | 10131520 | A | 5/1998 | |

* cited by examiner

WINDOW FOR AN ABOVE-GROUND POOL

CROSS-REFERENCE TO RELATED APPLICATION

This application is a 35 U.S.C. § 371 national stage application of PCT Application Ser. No. PCT/CN2017/082993, filed on May 4, 2017, which is hereby incorporated by reference in its entirety and for which priority is claimed for the present application.

BACKGROUND

Above-ground pools typically have exposed sidewalls that are supported by framing structures; and the walls can accommodate windows for providing visibility into and out of the pool. The windows and their attachments to the pool wall are subject to mechanical stress and deformation due to the weight of the water within the pool.

SUMMARY

At least one aspect is directed to a window for an above-ground pool. The window includes a window portion. The window portion includes a window pane and a peripheral rim around a perimeter of the window pane. The peripheral rim defines a first groove between a first outer flange and a first inner flange on a first side of the peripheral rim, and a second groove between a second outer flange and a second inner flange on a second side of the peripheral rim opposite the first side. The window includes a retainer bracket. The retainer bracket includes a peripheral rim junction having a receiving part configured to interlock with the first groove, the first outer flange, the second groove, and the second outer flange of the peripheral rim. The retainer bracket includes a peripheral plate configured to attach to a wall of a pool. The retainer bracket includes a joint connecting the peripheral rim junction and the peripheral plate. The retainer bracket defines a retainer bracket groove between the peripheral rim junction and the peripheral plate to allow the joint to provide strain relief for relative movement between the peripheral rim junction and the peripheral plate.

In some implementations, the peripheral rim includes a plurality of apertures defined in a bottom of the first groove, and the peripheral rim junction includes a plurality of protrusions configured to interlock with the plurality of apertures when the peripheral rim and the peripheral rim junction interlock.

In some implementations, a connection between the peripheral rim and the peripheral rim junction, when interlocked, is watertight without the use of a sealant or adhesive.

In some implementations, the window portion is a single, integrally molded part.

In some implementations, wherein the window portion includes acrylonitrile butadiene styrene (ABS).

In some implementations, the window pane is transparent.

In some implementations, the window portion is curved.

In some implementations, the retainer bracket is a single, integrally molded part.

In some implementations, the retainer bracket includes polyvinyl chloride (PVC).

At least one aspect is directed to a window for an above-ground pool. The window includes a window portion. The window portion includes a window pane and a peripheral rim around a perimeter of the window pane. The peripheral rim has a first interlocking member. The window includes a retainer bracket. The retainer bracket includes a peripheral rim junction having a second interlocking member configured to interlock with the first interlocking member. The retainer bracket includes a peripheral plate configured to attach to a wall of a pool. The retainer bracket includes a strain relief connecting the peripheral rim junction and the peripheral plate.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification.

BRIEF DESCRIPTION OF THE DRAWINGS

The above-mentioned and other features, properties and advantages of the present invention will become more apparent from the following description of embodiments with reference to the accompanying drawings, in which.

DETAILED DESCRIPTION

The present invention will be further described below in conjunction with detailed embodiments and the accompanying drawings. More details are provided in the following detailed description in order for the present invention to be fully understood. However, the present invention can be implemented in various ways other than those described herein. A person skilled in the art can make similar analogy and modification according to the practical applications without departing from the spirit of the present invention, and therefore the contents of the detailed embodiments herein should not be construed as limiting to the scope of the present invention.

Windows in above-ground pools are subject to mechanical stress and deformation due to the weight of the water within the pool. Traditionally, above-ground pool windows have been constructed of many parts, including screws or other fasteners for attaching the window to the pool. Windows of the present disclosure can be constructed from as few as two components and, in some implementations, without the need for additional parts or fasteners.

FIGS. 1-4 illustrate an example implementation of a window for an above-ground pool, according to the teachings of the present disclosure. These drawings are used as examples, are not necessarily drawn to scale, and should not be construed as limiting the scope of the disclosure.

Figure 1:
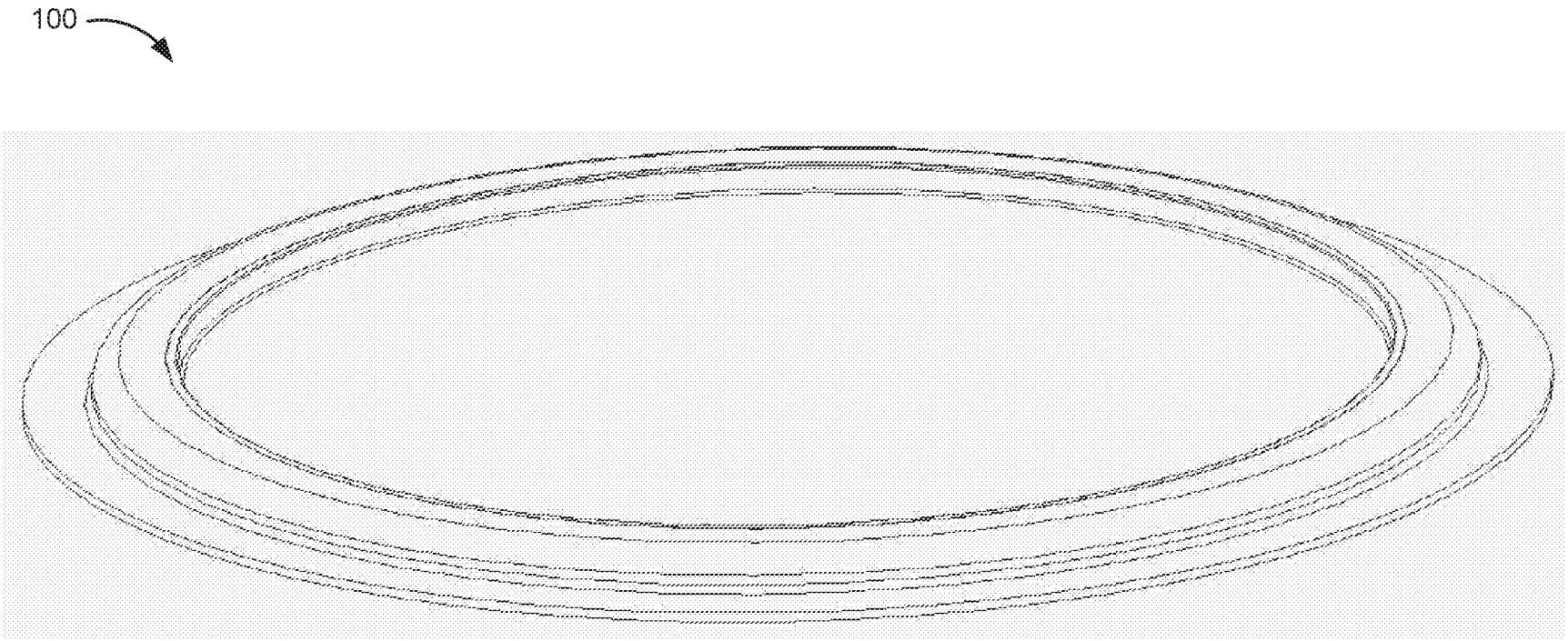
FIG. 1 illustrates a perspective view of a view window, according to an illustrative implementation.
Figure 2A:
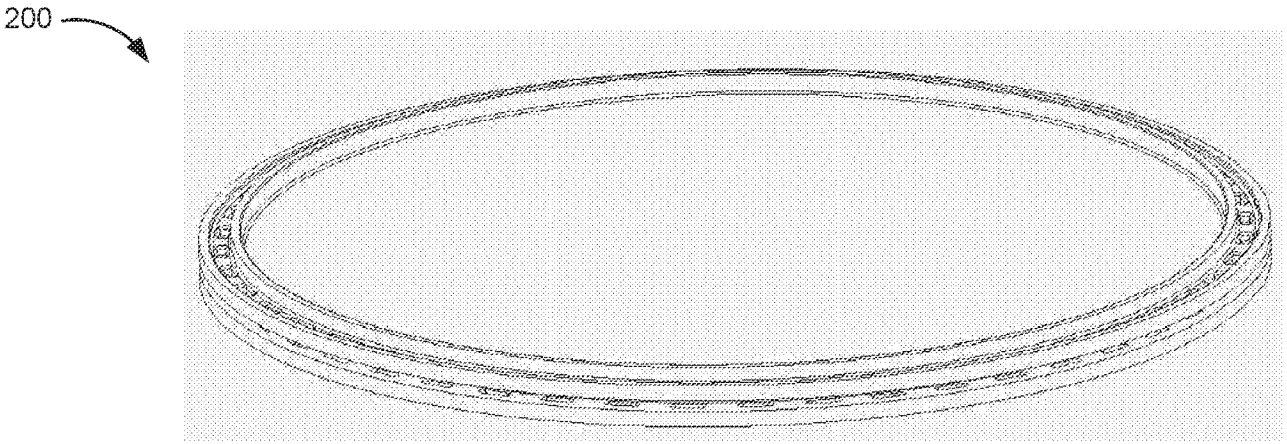
FIG. 2A illustrates a perspective view of a window portion, according to an illustrative implementation.
Figure 2B:
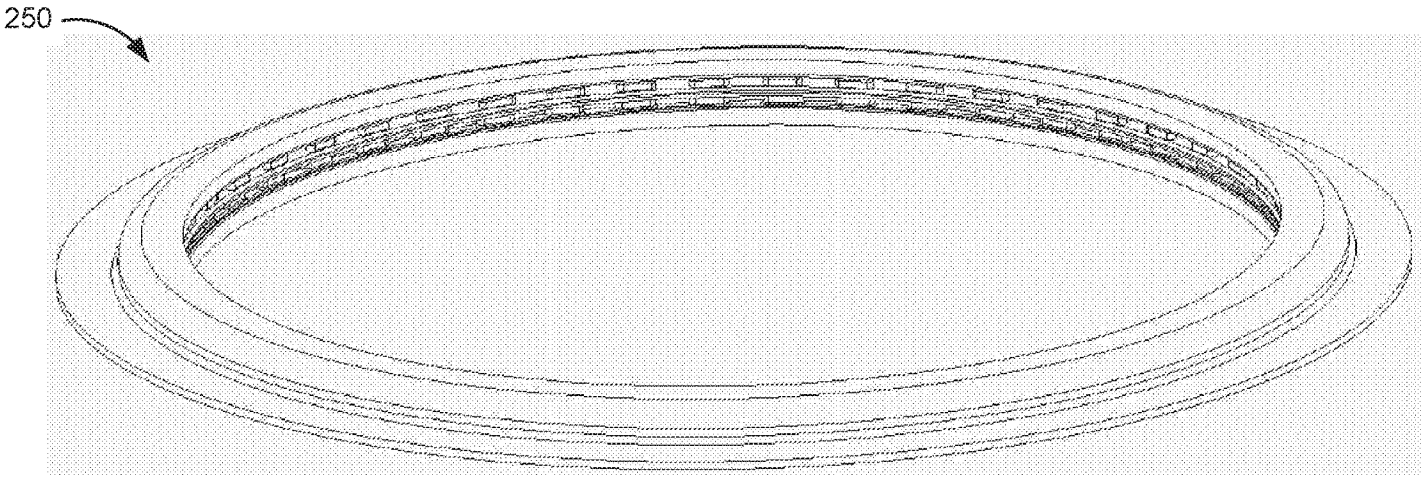
FIG. 2B illustrates a perspective view of a retainer bracket, according to an illustrative implementation.

FIG. 1 illustrates a perspective view of a view window 100, according to an illustrative implementation. In some implementations, the view window 100 can be a flat plate. In some implementations, the view window 100 can be curved to match the curvature of the pool wall in which it is mounted. In some implementations, the view window 100 is substantially round in shape. In some implementations, the view window 100 can be elliptical, rectangular, polygonal, or include a combination of straight and curved edges. The view window 100 includes an interlocked window portion 200 and a retainer bracket 250, shown separated in FIGS. 2A and 2B, respectively.

Figure 3A:
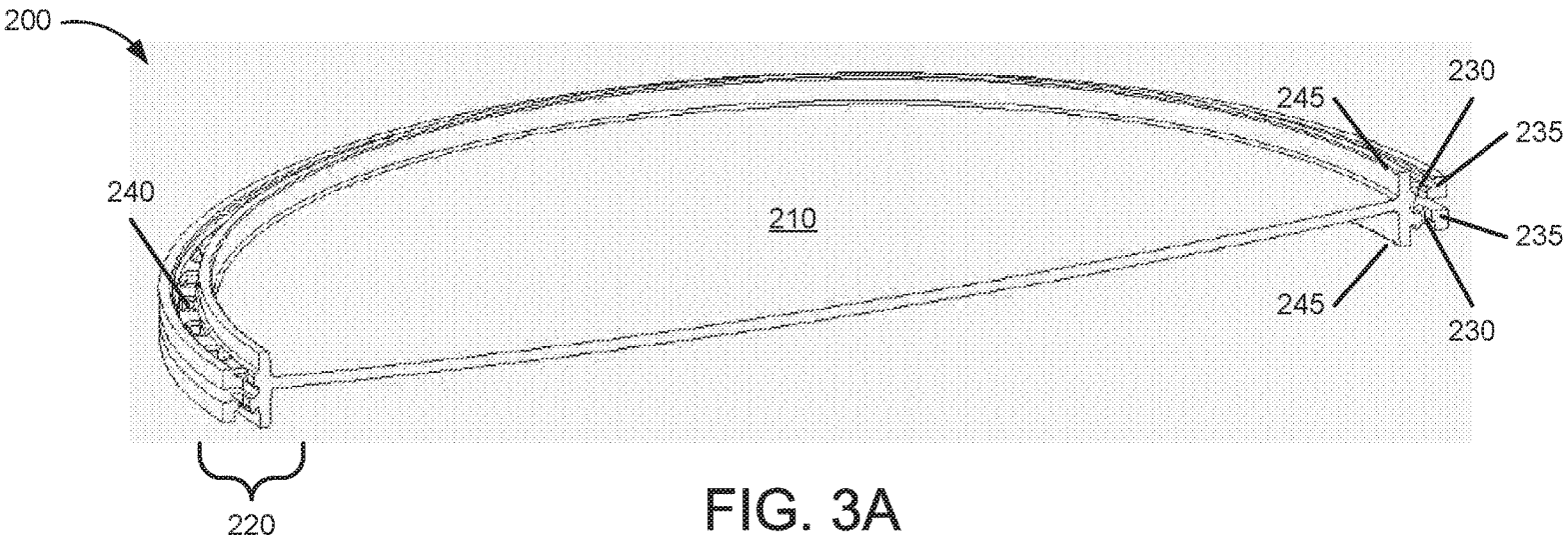
FIG. 3A illustrates a perspective view of a cross section of a window portion, according to an illustrative implementation.
Figure 3B:
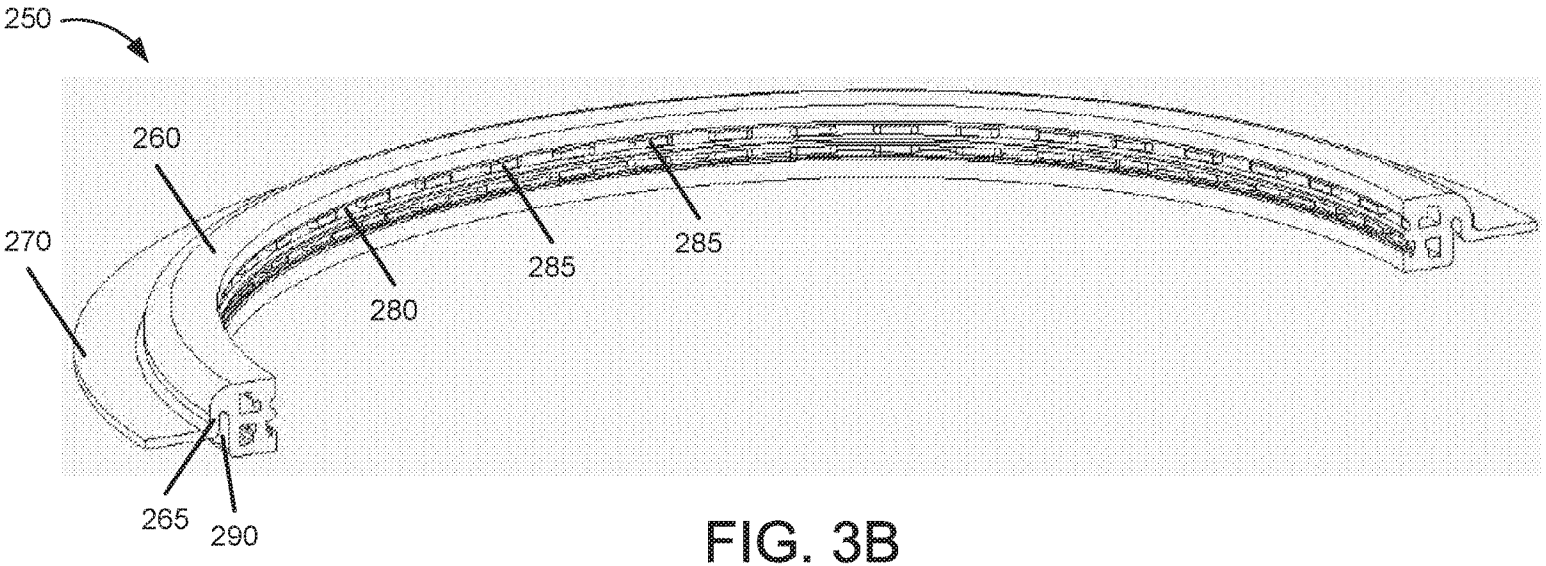
FIG. 3B illustrates a perspective view of a cross section of a retainer bracket, according to an illustrative implementation.

FIGS. 3A and 3B show perspective views of cross sections of the window portion 200 and the retainer bracket 250, respectively. The window portion 200 includes a window pane 210, and a peripheral rim 220 around the circumference or perimeter of the window pane 210. The peripheral rim 220 is thicker than the window pane 210 and includes features for interlocking with structures of the retainer bracket 250. The peripheral rim 220 includes inner outer flanges 235 and inner flanges 245, which together define window grooves 230 around the middle of the peripheral rim 220. In some implementations, the peripheral rim 220 can define a plurality of apertures 240 in the bottom of the window grooves 230. The window portion 200 can be an single, integrally molded part. In some implementations, the window portion 200 can be formed from a polymer such as acrylonitrile butadiene styrene (ABS) or similar material that achieves high strength while allowing for the window pane to be transparent or nearly transparent.

The retainer bracket 250 shown in FIG. 3B can have a shape that is cyclic annular. The retainer bracket 250 includes a peripheral rim junction 260 and a peripheral plate 270 connected by a joint 265. The peripheral rim junction 260 defines a receiving part 280, which is a cavity configured to receive and interlock with a portion of the peripheral rim 220 of the window portion 200. When the peripheral rim 220 and the peripheral rim junction 260 interlock, the outer flanges 235 can be disposed in the receiving part 280. In some implementations, the peripheral rim junction 260 can include a plurality of protrusions 285 into the receiving part 280. When the peripheral rim 220 and the peripheral rim junction 260 interlock, the protrusions 285 can protrude into the apertures 240. The retainer bracket 250 defines a retainer bracket groove 290 between the peripheral rim junction 260 and the peripheral plate 270. The retainer bracket groove 290 elongates the joint 265 to provide strain relief between the peripheral rim junction 260 and the peripheral plate 270. The retainer bracket 250 can be single, integrally molded part. In some implementations, the retainer bracket 250 can be formed from a polymer such as polyvinyl chloride (PVC), which can be relatively flexible compared to the material forming the window portion 200.

Figure 4:
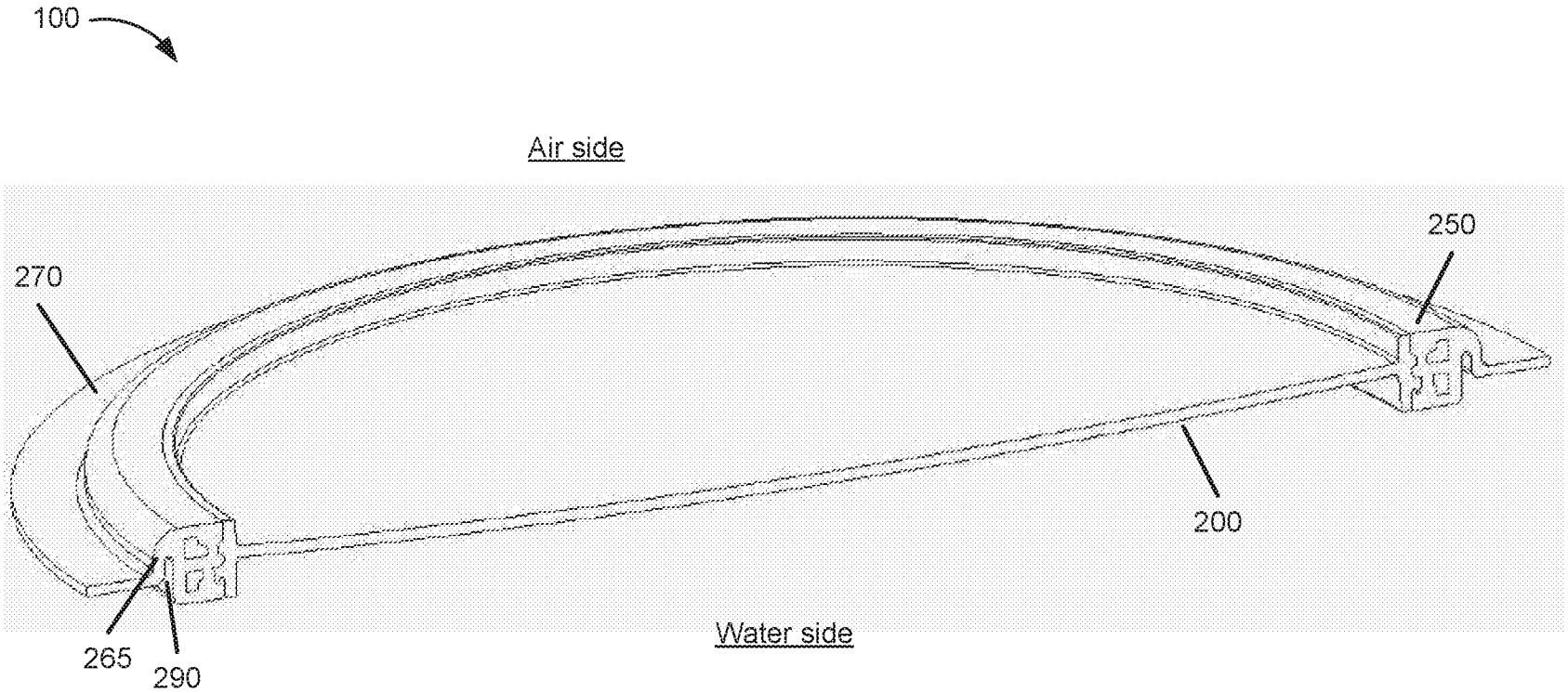
FIG. 4 illustrates a perspective view of a cross section of a view window showing an interlocked window portion and retainer bracket, according to an illustrative implementation.

FIG. 4 illustrates a perspective view of a cross section of a view window showing an interlocked window portion 200 and retainer bracket 250, according to an illustrative implementation. To interlock the window portion 200 and the retainer bracket 250, the window portion 200 can be held fast while an inside edge of the peripheral rim 260 is stretched radially and pushed or pulled over the flanges 235 with the aid of a lever or fixture. When interlocked, the flanges 235 are then disposed within the receiving part 280. A portion of the peripheral rim junction 260 will be disposed within the window groove 230. In some implementations, the protrusions 285 can protrude into the apertures 240. The interlocking of the outer flange 235 and peripheral rim junction 260 (and, in some implementations, the apertures 240 and protrusions 285) can create a mechanical connection that is robust with respect to shear forces in a direction normal to a plane of the window portion 200, and tensile forces in a direction parallel to the plane of the window portion 200. In some implementations, the connection between the window portion 200 and the retainer bracket 250 is watertight without a need for a sealant or adhesive. In some implementations, a sealant, such as silicone, or an adhesive, such as a transition cement, can be added to connection points between the window portion 200 and the retainer bracket 250 before or after the parts are interlocked to improve water tightness of the connection. The peripheral plate 270 can be welded to a side wall of the pool. When installed in the pool wall, the retainer bracket groove 290 will face inward towards the water. The peripheral plate 270 will be positioned inside of at least an outer wall of the pool wall. The outer side of the peripheral plate 270—i.e., the side opposite the retainer bracket groove 290—can be welded to the inside surface of the pool wall using a solvent or adhesive.

When the view window 100 is installed in the pool wall and the pool is filled with water, the view window 100 will experience multiple counteracting forces. First, the view window 100 will experience counteracting forces between the peripheral plate 270 being held in place by a wall of the pool, and an outward force on the window portion 200 caused by the weight of the water. The counteracting forces create a sheer stress in the joint 265 between the peripheral plate 260 and the peripheral rim junction 270. Second, the force of the water pushing outward on all walls of the pool may cause the wall to stretch laterally, applying a tensile stress directed from the center of the view window 100 radially outward in the plane of the view window 100. The tensile stress will be greater in the horizontal direction than in the vertical direction.

The joint 265 can provide strain relief between the peripheral rim junction 260 and the peripheral plate 270 by introducing a degree of flexibility between the two. The joint 265 can deform under the sheer and tensile stresses, and reduce deformation of the peripheral rim junction 260 and the receiving part 280. This can ensure that the connection between the peripheral rim 220 and the peripheral rim junction 260 maintains good contact and a watertight seal.

The present invention has been described above in connection with example implementations which, however, are not intended to be limiting to the scope of the present invention, and any person skilled in the art could make possible changes and modifications without departing from the spirit and scope of the present invention. Hence, any alteration, equivalent change and modification which are made to the above-mentioned examples in accordance with the technical substance of the present invention and without departing from the spirit of the present invention, would fall within the scope defined by the claims of the present invention.

What is claimed is:

1. A window for an above-ground pool, the window comprising:

a window portion including a window pane;

a peripheral rim extending around at least a portion of a perimeter of the window pane, the peripheral rim defining a first groove between a first outer flange and a first inner flange on a first side of the peripheral rim, and a second groove between a second outer flange and a second inner flange on a second side of the peripheral rim opposite the first side; and a retainer bracket including a peripheral rim junction having a receiving part configured to interlock with the first groove, the first outer flange, the second groove, and the second outer flange of the peripheral rim, a peripheral plate configured to attach to a wall of a pool, and a joint connecting the peripheral rim junction and the peripheral plate, wherein the retainer bracket defines a retainer bracket groove between the peripheral rim junction and the peripheral plate to allow the joint to provide strain relief for relative movement between the peripheral rim junction and the peripheral plate;

wherein:

the peripheral rim includes a plurality of apertures defined in a bottom of the first groove, and the peripheral rim junction includes a plurality of protrusions configured to interlock with the plurality of apertures when the peripheral rim and the peripheral rim junction interlock.

2. The window of claim 1, wherein a connection between the peripheral rim and the peripheral rim junction, when interlocked, is watertight without the use of a sealant or adhesive.

3. The window of claim 1, wherein the window portion includes acrylonitrile butadiene styrene (ABS).

4. The window of claim 1, wherein the window portion is substantially transparent.

5. The window of claim 1, wherein the window portion is curved.

6. The window of claim 1, wherein the retainer bracket is a single, integrally molded part.

7. The window of claim 1, wherein the retainer bracket includes polyvinyl chloride (PVC).

8. A window for an above-ground pool, the window comprising:

a window portion including a window pane, wherein the window portion is a single, integrally molded part;

a peripheral rim extending around at least a portion of a perimeter of the window pane, the peripheral rim defining a first groove between a first outer flange and a first inner flange on a first side of the peripheral rim, and a second groove between a second outer flange and a second inner flange on a second side of the peripheral rim opposite the first side; and a retainer bracket including a peripheral rim junction having a receiving part configured to interlock with the first groove, the first outer flange, the second groove, and the second outer flange of the peripheral rim, a peripheral plate configured to attach to a wall of a pool, and a joint connecting the peripheral rim junction and the peripheral plate, wherein the retainer bracket defines a retainer bracket groove between the peripheral rim junction and the peripheral plate to allow the joint to provide strain relief for relative movement between the peripheral rim junction and the peripheral plate.

9. A window for an above-ground pool, the window comprising:

a window portion including a window pane, wherein the window portion is a single, integrally molded part;

a peripheral rim around a perimeter of the window pane, the peripheral rim having a first interlocking member; and a retainer bracket including a peripheral rim junction having a second interlocking member configured to interlock with the first interlocking member, a peripheral plate configured to attach to a wall of a pool, and a strain relief connecting the peripheral rim junction and the peripheral plate.

10. The window of claim 9, wherein a connection between the peripheral rim and the peripheral rim junction, when interlocked, is watertight without the use of a sealant or adhesive.

11. The window of claim 9, wherein the window portion includes acrylonitrile butadiene styrene (ABS).

12. The window of claim 9, wherein the window portion is transparent.

13. The window of claim 9, wherein the window portion is curved.

14. The window of claim 9, wherein the retainer bracket is a single, integrally molded part.

15. The window of claim 9, wherein the retainer bracket includes polyvinyl chloride (PVC).

* * * * *